US011279454B2

(12) United States Patent
Rodriguez Rondon et al.

(10) Patent No.: US 11,279,454 B2
(45) Date of Patent: Mar. 22, 2022

(54) SYSTEM AND METHOD FOR CONTROLLING HYDROFOIL BOATS; AND HYDROFOIL BOAT COMPRISING SAID CONTROL SYSTEM

(71) Applicant: Eyefoil S.L, San Sebastian (ES)

(72) Inventors: Eloy Rodriguez Rondon, San Sebastian (ES); Hugo Ramos Castro, San Sebastian (ES); Diego Alonso Fernandez, San Sebastian (ES)

(73) Assignee: Eyefoil S.L, San Sebastian (ES)

( * ) Notice: Subject to any disclaimer, the term of this patent is extended or adjusted under 35 U.S.C. 154(b) by 354 days.

(21) Appl. No.: 16/693,409

(22) Filed: Nov. 25, 2019

(65) Prior Publication Data

US 2020/0172213 A1 Jun. 4, 2020

(30) Foreign Application Priority Data

Nov. 23, 2018 (ES) ..... ES201831137

(51) Int. Cl.
*B63B 79/15* (2020.01)
*B63B 79/40* (2020.01)
*B63B 1/28* (2006.01)

(52) U.S. Cl.
CPC ..... *B63B 79/40* (2020.01); *B63B 1/285* (2013.01); *B63B 79/15* (2020.01)

(58) Field of Classification Search
CPC ..... B63B 79/40; B63B 1/285; B63B 79/15; C10L 10/00; C10L 1/2335; C10L 1/231; A01N 31/04; A01N 43/84; A01N 33/18; A01N 31/14; A01N 2300/00; C10M 133/50; C10M 2215/226; C10N 2040/36; C10N 2030/16; C10N 2040/20
See application file for complete search history.

(56) References Cited

U.S. PATENT DOCUMENTS

| | | | | |
|---|---|---|---|---|
| 3,175,526 | A | 3/1965 | Johnson, Jr. et al. | |
| 3,364,892 | A | 1/1968 | Persson et al. | |
| 8,181,380 | B2 * | 5/2012 | Lankinen | A01K 91/20 43/17.1 |
| 2007/0292278 | A1 * | 12/2007 | Cornell | B63H 11/103 417/245 |

(Continued)

FOREIGN PATENT DOCUMENTS

| | | |
|---|---|---|
| GB | 2527055 | 12/2015 |
| WO | WO 2015/187102 | 12/2015 |

OTHER PUBLICATIONS

Bousquet et al., Control of a flexible, surface-piercing hydrofoil for high-speed, small-scale applications, 2017, IEEE, p. 4203-4208 (Year: 2017).*

(Continued)

*Primary Examiner* — McDieunel Marc

(57) ABSTRACT

The invention relates to a system for controlling a hydrofoil boat comprising at least three static pressure or dynamic pressure and water speed sensors submerged in the water and located on the submerged hydrofoils of the boat, an electronic controller on the boat, an actuator for each one of the submerged hydrofoils able to change an angle of attack of its respective hydrofoil. The control system allows boats on hydrofoils to sail in a safe and comfortable way in any wave condition within the sailing limits of traditional boats.

5 Claims, 5 Drawing Sheets

(56) References Cited

U.S. PATENT DOCUMENTS

| | | | | |
|---|---|---|---|---|
| 2009/0299501 | A1* | 12/2009 | Lankinen | A01K 91/20 700/56 |
| 2021/0098143 | A1* | 4/2021 | Trojer | G21C 19/07 |

OTHER PUBLICATIONS

Bousquet et al., The UNAV, a Wind-Powered UAV for Ocean Monitoring: Performance, Control and Validation, 2018, IEEE, pg. (Year: 2018).*

Font et al., Experimental determination of the hydrofoil's angle of attack in the case of a turtle-like Autonomous Underwater Vehicle, 2011, p. 1-5 (Year: 2011).*

Zufferey et al., SailMAV: Design and Implementation of a Novel Multi-Modal Flying Sailing Robot, 2019, IEEE, p. 2894-2901 (Year: 2019).*

Estado de la Tecnica e Opinion Escrita [Search Report and Written Opinion] dated Apr. 1, 2019 From the ministerio de Industria, Comercio y Turismo, Officina Espanola de Patentes y Marcas Re. Application No. 201831137. (8 Pages).

* cited by examiner

SYSTEM AND METHOD FOR CONTROLLING HYDROFOIL BOATS; AND HYDROFOIL BOAT COMPRISING SAID CONTROL SYSTEM

RELATED APPLICATION

This application claims the benefit of priority of Spanish Patent Application No. P201831137 filed on Nov. 23, 2018, the contents of which are incorporated herein by reference in their entirety.

FIELD AND BACKGROUND OF THE INVENTION

The present invention falls within the type of boats known as hydrofoils. The invention specifically relates to a system and a method for controlling hydrofoil boats, as well as to a hydrofoil boat that includes said control system. The invention may be used for sailing or motor-powered boats.

A hydrofoil is essentially a wing that is used in the water. The lift and drag provided by a wing in any fluid can be explained by the following formulas:

$$L = \frac{1}{2}\rho S V^2 \cdot C_L$$

$$D = \frac{1}{2}\rho S V^2 \cdot C_D$$

Where:

L is the lift of the wing (N). It depends on the Reynolds number and geometry.

D is the drag of the wing (N). It depends on the Reynolds number and geometry.

ρ is the density of the fluid (kg/m$^3$)

S is the base surface area of the wings (m$^2$)

V is the fluid velocity (m/s)

$C_L$ is the lift coefficient (dimensionless). In an incompressible regime, it depends on the angle of attack and the Reynolds number.

$C_D$ is the drag coefficient (dimensionless). In an incompressible regime, it depends on the angle of attack and the Reynolds number.

Given that the density of water is approximately 1,000 times greater than the density of air, in the case of two wings with the same geometry moving at the same speed, one in the water and the other in the air, the lift generated for the one submerged in water is 1,000 times greater than the one submerged in air. This is the reason why a boat that has a relatively small hydrofoil, which is kept under the water surface, can generate enough lift to keep the hull above the water. By lifting the hull out of the water, the boat's drag is considerably reduced and this allows the boat to reach greater speeds.

Hydrofoils have been used on boats since the middle of the 20th century. The majority of boats with hydrofoils have two basic concepts for controlling the lift of the hydrofoils, thereby making sailing possible, as will be explained below:

Control by the submerged surface.

The lift of the lifting surfaces is adjusted by changing the submerged surface and therefore the lifting surface.

Control by the angle of attack

The lift of the lifting surfaces is adjusted by changing the angle of attack of the same, always keeping them entirely submerged.

Mixed control system.

In the mixed control system, the two systems for adjusting the aforementioned lift are combined, such that both the surface and the angle of attack are changed.

Given that the invention proposed is based on controlling the angle of attack according to the state of the art, a detailed explanation of the functioning of sailboats that are controlled by the angle of attack is provided using the Flying Moth as an example.

As can be seen in FIGS. 1 and 2, this type of boat (100) has two lift surfaces; one hydrofoil on the rudder (101) end and another on the keel (102). When the boat (100) is traveling at a speed greater than the "take-off" speed, the hull comes out of the water, both surfaces lift, and thus the sum of both lifting forces offset the weight of the boat with the crew. Due to the fact that lift is proportional to the speed squared and to the angle of attack, the angle of attack of the hydrofoil of the keel (102) must be changed as the speed of the boat (100) varies, in order to always be able to provide a lift that is equal to the weight of the boat plus the crew. This is done by an aileron on the hydrofoil of the keel (102). The aileron is actuated by a wand system (103). The wand (103) is a system or sensor that measures the height of the hull with respect to the water.

In the theoretical case that the boat (100) is going at a speed at which all forces are compensated, if the speed of the boat (100) is increased, the lift is increased and the boat (100) will begin to come out of the water, thereby increasing the height of the hull over the water. Thus, when the boat (100) begins to increase its height over the water, the angle of attack of the hydrofoils must be decreased to prevent the hydrofoils from coming out of the water or coming too close to the free surface. This height is measured by the wand (103), which consists of a rod with a floater at the end that follows the surface of the water. The rod therefore provides a measurement of the height above the water. This rod is connected to the aileron of the hydrofoil of the keel (102) and adjusts the aileron of the hydrofoil, adjusting its angle of attack.

The wand (103), which is a mechanical measuring system, is often substituted by electronic sensors coupled to a controller that sends orders to the ailerons of the hydrofoil.

The balance of forces and torques on the rest of the axes is achieved by the position of the crew and by modifying the angle of attack of the rudder (101).

Boats (100) have two type of movements or ways to face or pass through waves: one in which the height of the boat (100) does not change with respect to the average surface of the sea, and another in which they follow the shape of the wave. These two movements are illustrated in FIG. 4.

The main problem with current hydrofoil boats (100) is that they do not sail well, or cannot sail at all, with waves. To illustrate this point, let us imagine a boat balanced and on a flat sea sailing directly towards a single wave that is approaching. The first problem is the difficulty in accurately measuring the height of the wave. The most accurate electronic sensors available are not able to correctly measure the surface, and once the signal is filtered, the measurement is not as precise as necessary. Above certain slopes of the wave, the sensors lose the measurement, and as such there is not a continued measurement of the height. Mechanical sensors are even less accurate.

The second problem is that the height sensor measures the height in an area near the vertical of its location, and thus the measurement is taken very close to the bow. This means that the controller sends a signal to the ailerons at the moment the wave begins to pass below the bow. If the wave has a steep slope, from the time the aileron is actuated to the time the bow lifts is insufficient in preventing the wave from reaching the hull. When the water hits the boat, it slows down and the hydrofoils are no longer able to lift the weight of the boat.

SUMMARY OF THE INVENTION

It is necessary to provide an alternative to the state of the art that provides a solution to the shortcomings of the same, and therefore, unlike current solutions, this invention proposes a solution so that boats are able to sail on hydrofoils in a greater swell range. This will allow the behaviour of these types of vessels on the sea to be improved and will therefore allow them to sail in sea, wind and swell conditions which cannot currently be sailed in, thus allowing these vessels to travel farther than they currently can, far from the port even when there is a possibility that the swell will worsen.

According to a first aspect of the invention, the invention specifically relates to system for controlling hydrofoil boats, wherein the control system comprises:

At least three static pressure or dynamic pressure sensors (201) and three water speed sensors (201) submerged in the water and located on the submerged hydrofoils of the boat (100). Each pressure sensor (201) must have an associated speed sensor at the same measuring point, or very close to it. The measuring points must not be aligned.

An on-board electronic controller; and

One actuator for each one of the submerged hydrofoils, able to change the angle of attack of its respective hydrofoil, wherein the electronic controller is arranged to periodically collect information from the static/dynamic pressure and water speed sensors (201) and act in real time on the actuators of said submerged hydrofoils, such that when there is a wave, the actuation on the hydrofoils allows the boat to follow the surface of the sea, and when there are no waves or the waves are small, the actuation allows the boat to maintain a constant height above the surface of the sea.

BRIEF DESCRIPTION OF THE SEVERAL VIEWS OF THE DRAWINGS

The previous advantages and features, in addition to others, shall be understood more fully in light of the following detailed description of embodiments, with reference to the following figures, which must be understood by way of illustration and not limitation, wherein.

DESCRIPTION OF SPECIFIC EMBODIMENTS OF THE INVENTION

Figure 1:
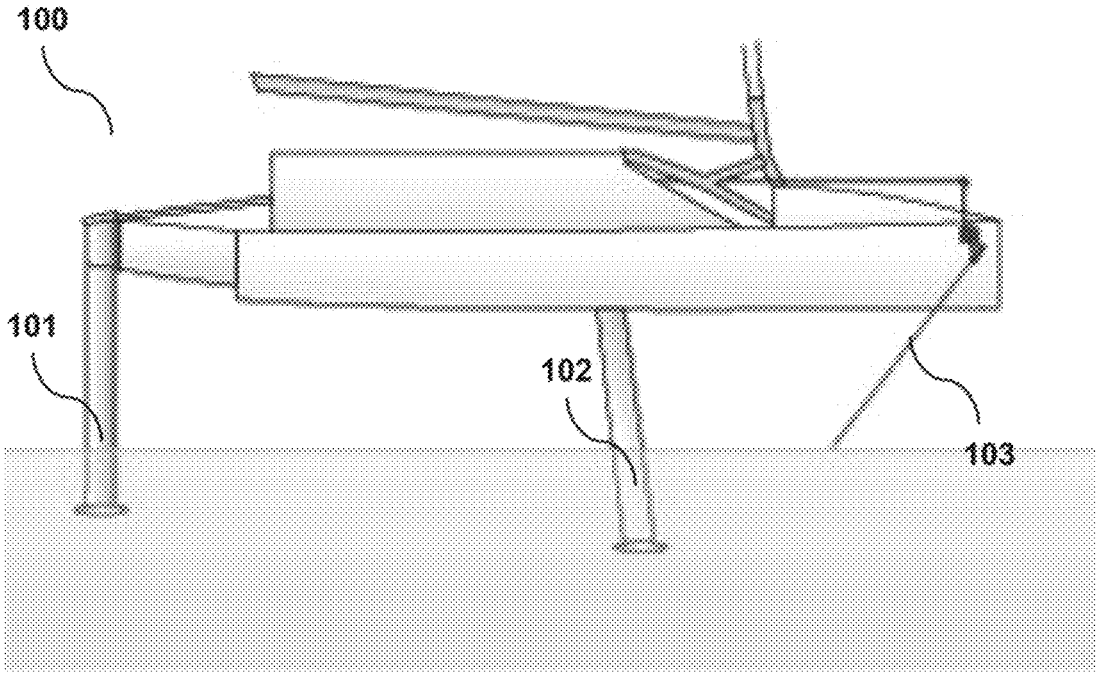
FIG. 1 shows a side view of a diagram of a flying moth-type boat of the state of the art, wherein the hydrofoils and the wand sensor for controlling the lift can be seen.
Figure 2:
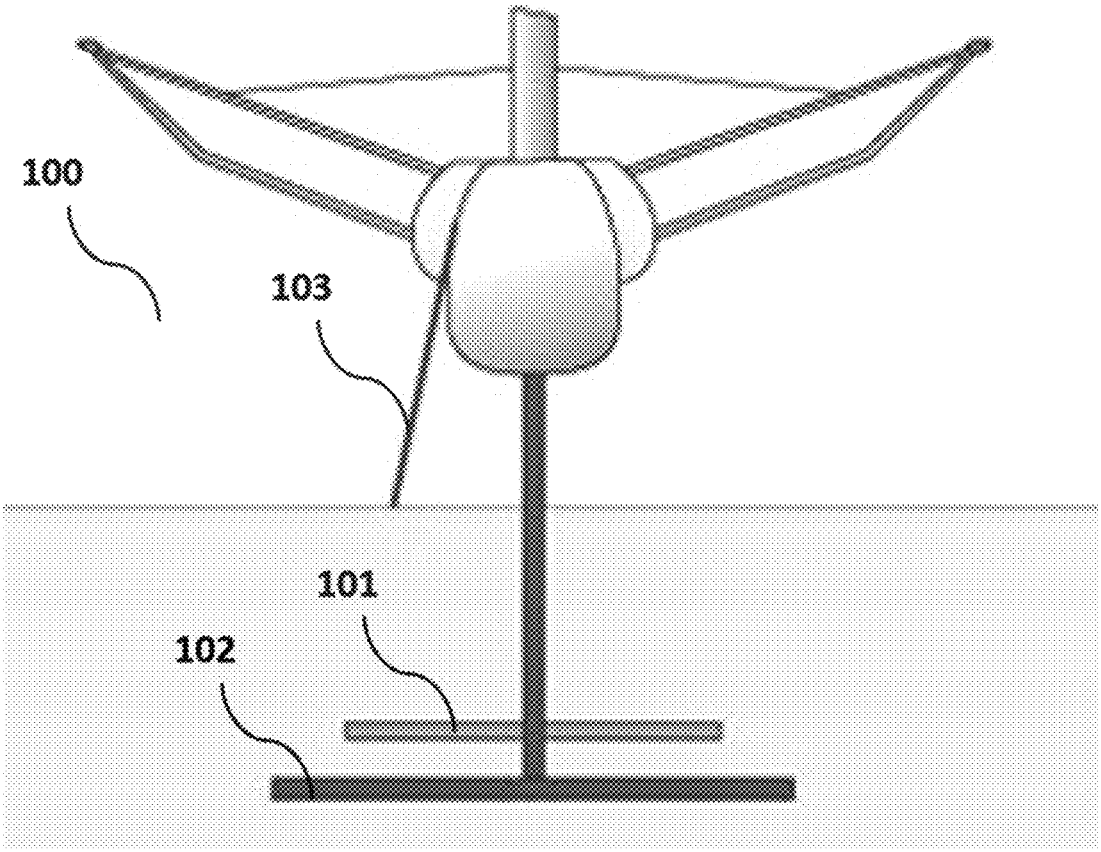
FIG. 2 shows a front view of a diagram of the boat of FIG. 1.

The invention substantially improves the ability of hydrofoil boats (100) to sail on waves. The system is based on controlling the boat (100) from the measurements of several pressure ($P_L$) sensors (201) and water speed ($V_L$) sensors (201) located on the lowest part of each appendix; i.e. keels (102) and rudder (101).

The objective of the control is for the boat (100) to follow the shape of the wave without the hull touching the water. With this objective, the control will act on the hydrofoils of the boat (100) to keep the total pressure constant at the points where the pressure and water speed are measured. This means that, as will be shown, the depth h(t) of the measuring points with respect to the water surface will be maintained within a range that allows the boat to follow the shape of the wave without the wave touching the hull. By applying Bernoulli's principle, the total pressure to be kept constant at one measuring point is:

$$P_T = P_L + \frac{1}{2}\cdot\rho\cdot V_L^2 = P_o + \rho\cdot g\cdot h_o + \frac{1}{2}\cdot\rho\cdot V_o^2$$

Where:

$P_L$≡Local Static Pressure measured by the sensor (201) at the measuring point.

$V_L$≡Local Speed measured by the sensor (201) at the measuring point.

$P_O$≡Atmospheric Pressure.

ρ≡Water density.

$h_O$≡Reference depth below the surface of the water without waves.

$V_O$≡Reference speed while sailing without waves. This speed can be matched at all times to the $V_L$.

g≡gravitational acceleration.

The total pressure is kept constant along the streamlines. One of the streamlines is a tangent to the profile where the sensor (201) is located. Supposing that the boat (100) maintains its speed with respect to the water ($V_O$), in the case that the hydrofoils are moving and thereby providing energy to the system, the total pressure at any point where the sensor (201) is located will be:

$$P_T \approx P_o + \rho\cdot g\cdot h(t) - \rho\cdot g\cdot\zeta(t)\left\{1 - \frac{h_w}{2}\cdot e^{\frac{2\cdot\pi}{\lambda_w}\cdot(\zeta(t)-h(t))}\right\} + \mathcal{L}(h(t),\alpha(t)) + \mathcal{M}(h(t),\alpha(t),\dot{\alpha}(t)) + \frac{1}{2}\cdot\rho\cdot V_o^2$$

$$\zeta(t) = \mp\frac{h_w}{2}\cdot\sin(\beta\cdot t)$$

$$\beta = \frac{2\pi V_o}{\lambda_W} \mp \sqrt{\frac{2\pi g}{\lambda_W}}$$

$$c = \mp\sqrt{\frac{\lambda_W\cdot g}{2\pi}}$$

Where:

t≡Time variable.

h(t)≡Depth of the measuring point below the surface of the water.

ζ(t)≡Equation of the wave.

$h_w$≡Semi-amplitude of the wave.

$\lambda_w$≡Wavelength of the wave.

$\mathcal{L}$ ≡Contribution to total pressure due to the influence of the lift of the hydrofoil.

α(t)≡Configuration of the angles of attack of the hydrofoils that affect the measurement of the sensor (201).

$\dot{\alpha}(t)$≡Derivative of the configuration of the angles of attack of the hydrofoils that affect the measurement of the sensor (201).

$\mathcal{M}$ ≡Contribution to total pressure due to the influence of the torque that is applied to the hydrofoil to change the angle of attack thereof.

$\mp$≡The negative sign (−) corresponds to the case in which the boat advances in the direction of the wave, and the positive sign (+) when the boat sails against the wave.

β≡Wave frequency.

c≡Speed of the wave train.

The contribution to the kinetic energy coming from the wave-induced water speed has been disregarded, due to the fact that it is of a smaller degree than the kinetic energy of the boat (100).

By identifying all terms, the following results:

$$P_L = P_o + \rho \cdot g \cdot h(t) - \rho \cdot g \cdot \zeta(t)\left\{1 - \frac{h_w}{2} \cdot e^{\frac{2\cdot\pi}{\lambda_w}\cdot(\zeta(t)-h(t))}\right\} + \mathcal{L}_P(h(t), \alpha(t)) + \mathcal{M}_P(h(t), \alpha(t), \dot{\alpha}(t))$$

$$\frac{1}{2} \cdot \rho \cdot V_L^2 \approx \mathcal{L}_V(h(t), \alpha(t)) + \mathcal{M}_V(h(t), \alpha(t), \dot{\alpha}(t)) + \frac{1}{2} \cdot \rho \cdot V_o^2$$

Where:

$\mathcal{L}_P$≡Contribution to the potential energy term of the total pressure due to the influence of the lift of the hydrofoil.

$\mathcal{L}_V$≡Contribution to the kinetic energy term of the total pressure due to the influence of the lift of the hydrofoil.

$\mathcal{M}_P$≡Contribution to the potential energy term of the total pressure due to the influence of the torque that is applied to the hydrofoil to change the angle of attack thereof.

$\mathcal{M}_V$≡Contribution to the potential energy term of the total pressure due to the influence of the torque that is applied to the hydrofoil to change the angle of attack thereof.

Thus, if a control strategy is implemented that maintains the total pressure constant and equal to a reference, the pressure sensor (201) will continue the path of a streamline corresponding to a Total Pressure equal to the reference.

$$P_{Tref} = P_o + \rho \cdot g \cdot h_o + \frac{1}{2} \cdot \rho \cdot V_L^2$$

The previous equation indicates that for a speed of the boat $V_L$, if the reference total pressure is increased, the sensor (201) will follow a deeper streamline and if the reference total pressure is decreased, it will be shallower.

Figure 3:
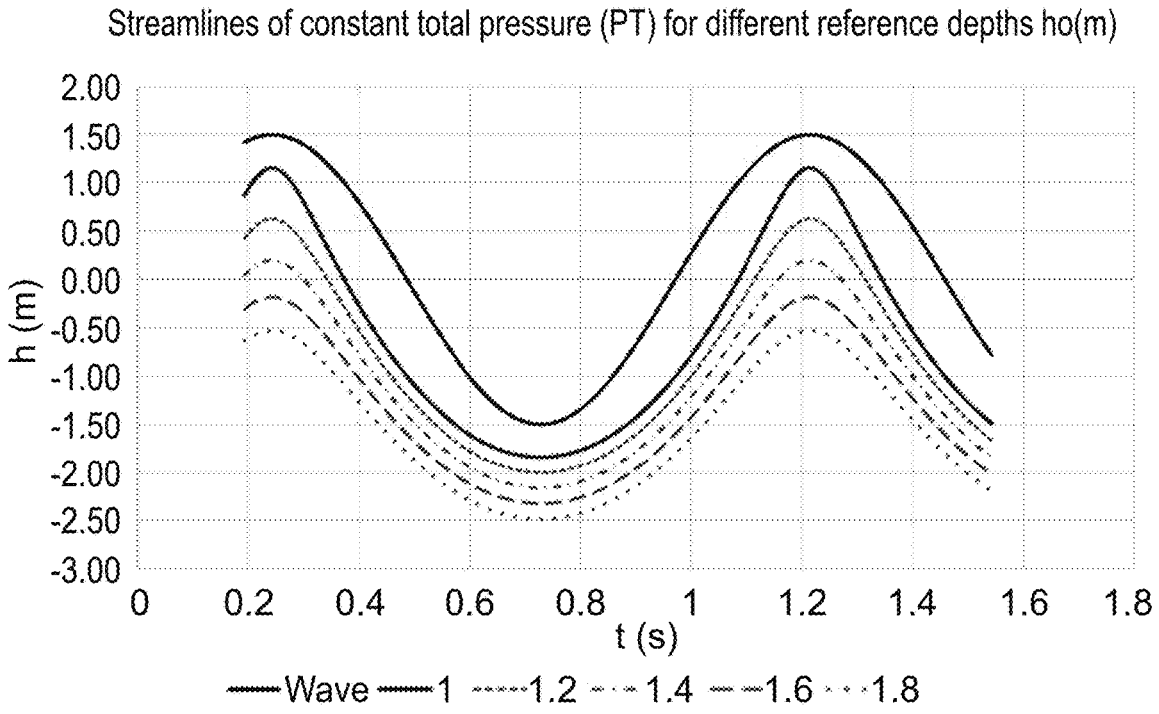
FIG. 3 shows two graphs with examples of the isobars of the total pressure (PT) under the wave, in other words, of the streamlines at different reference depths.

FIG. 3 shows the streamlines for different total pressures for different reference depths $h_O$: 1, 1.2, 1.4, 1.6 and 1.8 metres. Due to the exponential in the pressure differential formula, it is observed that as the reference depth increases, the streamlines or sensor (201) paths are flatter.

Figure 6:
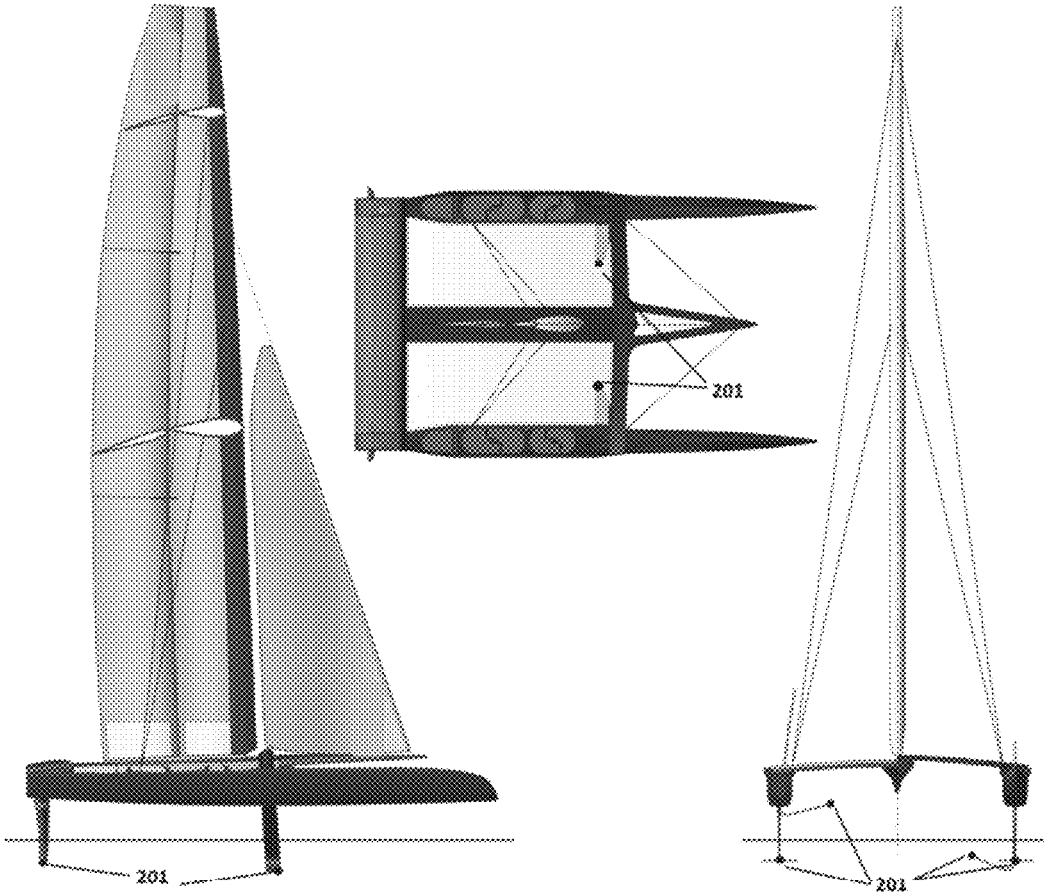
FIG. 6 shows a diagram of an example of the boat, type AC50, as well as the location of the pressure and speed sensors of the invention.

Based on FIG. 3 it can be concluded that a control system that has the aim of keeping the total pressure of a point of the hydrofoil constant will force the path of that hydrofoil to follow a streamline and thus follow the shape of the wave. To be able to implement this system, the pressure and speed sensors (201) must be located on the submerged hydrofoils, as shown in FIG. 6. If these sensors (201) are on all of the hydrofoils, the points of the hull where the appendixes, i.e. heels (102) and rudder (101), are attached, by being integrally joined to the hydrofoils, will follow paths parallel to the isobars of the hydrofoils, and thus, with the proper configuration of the controller, the boat (100) will be able to follow a path that follows the shape of the wave. If there are no waves, the boat (100) will maintain a constant height, given that the depth will be equal to the reference $h_O$. If the control is given a total pressure range, it will be able to maintain a constant height with respect to the free surface when the waves are small.

With respect to the foregoing, the error signal of the control will be the following:

$$\begin{aligned}\varepsilon = P_T - P_{ref} &= \\ &= P_L + \frac{1}{2} \cdot \rho \cdot V_L^2 - P_{ref} = P_o + \rho \cdot g \cdot h(t) - \rho \cdot g \cdot \\ &\quad \zeta(t)\left\{1 - \frac{h_w}{2} \cdot e^{\frac{2\cdot\pi}{\lambda_w}\cdot(\zeta(t)-h(t))}\right\} + \frac{1}{2} \cdot \rho \cdot V_L^2 - P_0 - \rho \cdot g \cdot h_o - \\ &\quad \frac{1}{2} \cdot \rho \cdot V_L^2 \\ &= \rho \cdot g \cdot \left[h(t) - h_o - \zeta(t)\left\{1 - \frac{h_w}{2} \cdot e^{\frac{2\cdot\pi}{\lambda_w}\cdot(\zeta(t)-h(t))}\right\}\right]\end{aligned}$$

Thus, in the aim of keeping the error signal at zero, the control will try to cancel the effect of the wave.

Based on the error signal of the control, several types of controls can be implemented. The simplest one is a PD, relating the angle of attack of the hydrofoils to the error signal, such that:

$$\alpha(t) = K_p \cdot \varepsilon + K_d \cdot \dot{\varepsilon}$$

Kp being the constant of proportionality of the control and Kd being the derivative constant of the control.

Figure 4:
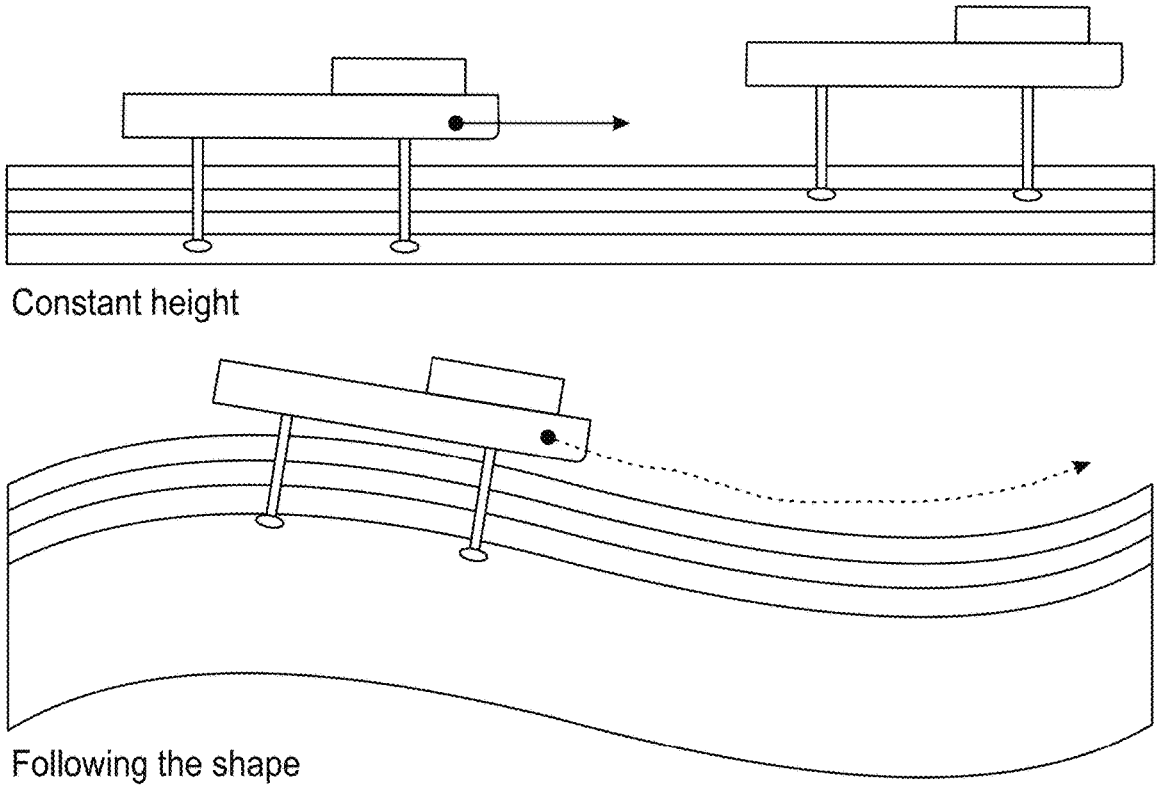
FIG. 4 shows drawings with the two sailing modes of these types of vessels: constant height and following the shape of the wave.

FIG. 3 shows a sinusoidal wave, when the waves of the sea are a wave spectrum. However, given that the streamlines represent a spectrum, they are very similar to those of FIG. 4, and thus the boat (100) sailing on waves of the sea will also follow the shape of the wave.

Furthermore, the equation corresponding to the total pressure of a wave spectrum has the same form as the previously mentioned equation. Thus, by having three pressure and speed measuring points, the larger amplitudes of the wave spectrum can be characterised. In other words, while sailing with waves, the control system can always calculate what the approaching wave train will be.

By having the wave spectrum of the wave on which the boat (100) is sailing, the controller can be adjusted such that the variation of the angles of attack of the hydrofoils with time allows the hydrodynamic forces to respond with enough time to lift or lower the bow/stern, following the shape of the wave, and thus the hull of the boat (100) will not touch the water.

Figure 5:
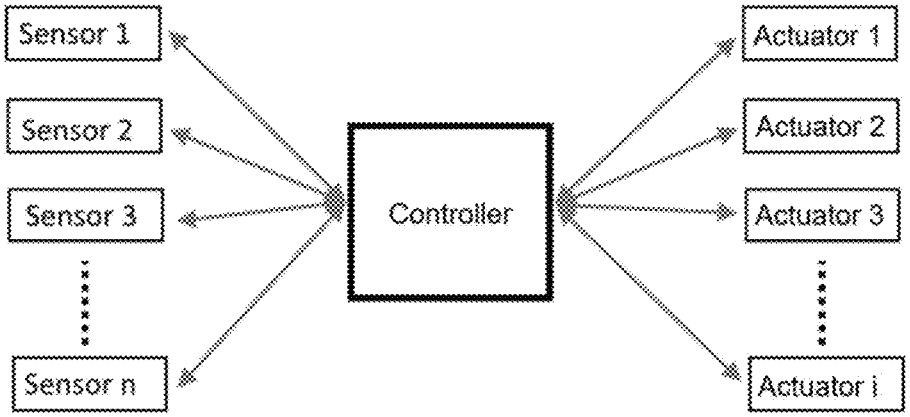
FIG. 5 shows a diagram of the high-level modules of the invention, including the controller, sensors and actuators forming the same.

The control system necessary for implementing this control method requires at least three sensors (201) situated on the hydrofoils that are submerged, an on-board processor in which the control algorithm and the actuators run in real time. The pressure and speed sensors (201) do not lose the measurement and provide a continuous signal; this is not the case for height sensors currently being used. FIG. 5 shows a high-level diagram of the location of the pressure sensors (201) of the invention in a typical boat (100). Nowadays there are several sensors (201) options for calculating pressure and speed: pitot tubes, ultrasonic sensors, infrared, etc., all of which are valid for this type of control.

What is claimed is:

1. A control system for hydrofoil boats able to change an angle of attack thereof, or having ailerons, the system comprising:

at least three sensors for measuring pressure and water speed, intended to be located on most submerged ends of the hydrofoils, an electronic controller intended to be placed on board, and one actuator for each one of the hydrofoils, each actuator connected to its respective hydrofoil to change the angle of attack or aileron of said hydrofoil, wherein the electronic controller is communicated with the sensors for periodically collecting the measurements taken by the sensors, as well as the electronic controller is connected to the actuators to act in real time on the actuators, in order to maintain constant values of total pressure of the water equal to a reference total pressure.

2. The control system for hydrofoil boats of claim 1, wherein the controller is configured to command the actuators of the hydrofoils to maintain the total pressure according to the following Bernoulli equation:

$$P_T = P_O + \rho \cdot g \cdot h_o + \frac{1}{2} \cdot \rho \cdot V_o^2$$

where:

$P_T$≡Total pressure measured by the sensor, $P_O$≡Atmospheric pressure,

ρ≡Water density, $h_O$≡Reference depth under the surface of the water without waves at which the sensor on the hydrofoil is located, g≡Gravitational acceleration, $V_O$≡Reference speed.

3. A boat comprising:

a hull, and at least two hydrofoils mounted with adjustable angles of attack, the boat further comprising the control system described in claim 1, wherein the sensors are located on the hydrofoils in positions intended to be submerged, as well as the electronic controller is on-board the hull, and wherein each one of the actuators is connected to its respective hydrofoil to change the angle of attack of said hydrofoil, and wherein the electronic controller is communicated with the sensors for periodically collecting the measurements taken by the sensors, as well as being connected to the actuators to act in real time on the actuators, to maintain the total pressure values constant.

4. A method for controlling a boat, wherein the boat is of the type comprising:

a hull, at least two hydrofoils mounted with adjustable angles of attack, at least three sensors for measuring pressure and speed, located on the hydrofoils in positions intended to be submerged, an electronic controller placed on the hull, and one actuator for each one of the hydrofoils, each actuator connected to its respective hydrofoil to vary the angle of attack said hydrofoil, wherein the electronic controller is communicated with the sensors for periodically collecting the measurements taken by the sensors, as well as being connected to the actuators to act in real time on the actuators, wherein the method comprises the following steps:

the controller receives pressure and water speed measurements taken by the sensors, and the controller sends the order to the actuators to modify the angle of attack of the hydrofoils to maintain a constant total pressure value.

5. The control method according to claim 4, wherein the total pressure is given by the following formula of the Bernoulli equation:

$$P_T = P_O + \rho \cdot g \cdot h_o + \frac{1}{2} \cdot \rho \cdot V_o^2$$

where:

$P_T$≡Total pressure measured by the sensor, $P_O$≡Atmospheric pressure,

ρ≡Water density, $h_o$≡Reference depth under the surface of the water without waves at which the sensor on the hydrofoil is located, g≡Gravitational acceleration, $V_O$≡Reference speed while sailing without waves.

* * * * *